US008111274B2

(12) United States Patent
Hirai et al.

(10) Patent No.: US 8,111,274 B2
(45) Date of Patent: Feb. 7, 2012

(54) THERMAL PRINTER

(75) Inventors: Kimitaka Hirai, Chiba (JP); Akihiko Ito, Chiba (JP)

(73) Assignee: Seiko Instruments Inc. (JP)

( * ) Notice: Subject to any disclaimer, the term of this patent is extended or adjusted under 35 U.S.C. 154(b) by 480 days.

(21) Appl. No.: 12/315,633

(22) Filed: Dec. 4, 2008

(65) Prior Publication Data

US 2009/0153640 A1 Jun. 18, 2009

(30) Foreign Application Priority Data

Dec. 14, 2007 (JP) ..... 2007-323595

(51) Int. Cl.
*B41J 2/335* (2006.01)

(52) U.S. Cl. ..... 347/220

(58) Field of Classification Search ..... 347/171, 347/220, 222; 400/58, 120.16, 120.17
See application file for complete search history.

(56) References Cited

U.S. PATENT DOCUMENTS

| | | | | |
|---|---|---|---|---|
| 6,249,302 | B1 * | 6/2001 | Sekiya | 347/220 |
| 6,336,760 | B2 * | 1/2002 | Mori et al. | 400/649 |
| 6,450,714 | B2 * | 9/2002 | Mori et al. | 400/649 |
| 7,561,173 | B2 * | 7/2009 | Hirai | 347/220 |
| 2004/0080604 | A1 | 4/2004 | Ito | 347/197 |
| 2004/0119808 | A1 | 6/2004 | Mori | 347/220 |
| 2007/0059074 | A1 | 3/2007 | Yoshioka | 400/120.16 |
| 2007/0286659 | A1 | 12/2007 | Yamada | 400/58 |

FOREIGN PATENT DOCUMENTS

EP 1403074 3/2004

* cited by examiner

*Primary Examiner* — Daniel Petkovsek
(74) *Attorney, Agent, or Firm* — Adams & Wilks

(57) ABSTRACT

A thermal printer has a thermal head pivotally mounted on a main body frame to pivot toward and away from a platen roller. The platen roller has shaft bearings at opposite ends thereof that are removably inserted in two spaced-apart opposed slots formed in the main body frame to rotatably support the platen roller. First springs bias a pivotal lock arm to a locked position to prevent removal of the shaft bearings from the slots, and second springs bias the thermal head toward the platen roller. Manual pivotal movement of the lock arm to an unlocked position permits removal of the shaft bearings from the shaft. The biasing directions of the first and second springs are parallel, which reduces the stroke distance of the first springs resulting in size reduction of the thermal printer.

18 Claims, 7 Drawing Sheets

THERMAL PRINTER

BACKGROUND OF THE INVENTION

1. Field of the Invention

The present invention relates to a thermal printer.

2. Description of the Related Art

Conventionally, as a thermal printer, there is known a thermal printer disclosed in Patent Document 1, for example. In the thermal printer disclosed in Patent Document 1 (JP 2000-318260 A), shaft bearings for bearing-supporting a platen roller are sandwiched between notches formed on main body frame side walls and lock arms, whereby the platen roller is mounted to the main body frame.

However, in the thermal printer described in Patent Document 1, there arises a problem in that, when the thermal paper placed (set) between the thermal head and the platen roller is pulled by excessive force for cutting, whereby the platen roller and the shaft bearings are moved to the side opposite to the supporting shaft, the platen roller and the shaft bearings turn (are released) in the direction of opening the lock arm to come off from the notches, thereby making the printing impossible afterward.

SUMMARY OF THE INVENTION

The present invention has been made in view of the above-mentioned problem, and it is an object of the present invention to provide a thermal printer capable of preventing a platen roller and shaft bearings from accidentally coming off from notches to thereby enable improvement in reliability.

The present invention employs the following means in order to solve the above-mentioned problem.

According to the present invention, there is provided a thermal printer including a main body frame, a thermal head swingably mounted to the main body frame, a platen roller which is disposed so as to be opposed to a printing surface of the thermal head and sandwiches thermal paper with the thermal head to feed the thermal paper, and a lock arm which is swingably mounted to a supporting shaft mounted to the main body frame and presses shaft bearings rotatably supporting the platen roller to a thermal head side to lock the platen roller with notches formed in the main body frame, in which the lock arm is provided, on a tip end portion thereof, with a first inclined surface which, when the platen roller and the shaft bearings are moved toward openings of the notches, comes into contact with an outer peripheral surface of each of the shaft bearings and generates a force in a direction of closing the lock arm.

According to the thermal printer of the present invention, even when the thermal paper placed (set) between the thermal head and the platen roller is pulled for cutting, whereby the platen roller and the shaft bearings are moved to the side opposite to the supporting shaft, the first inclined surface generates the force in the direction of closing the lock arm, and hence it is possible to prevent the platen roller and the shaft bearings from accidentally coming off from the notches (to prevent the platen roller from accidentally being released) to thereby enable improvement in reliability.

In the above-mentioned thermal printer, it is particularly preferable that the lock arm be provided, on the tip end portion thereof, with a second inclined surface which, when the platen roller and the shaft bearings are moved toward the openings of the notches, comes into contact with the outer peripheral surface of each of the shaft bearings and generates a force in a direction of opening the lock arm, and that the first inclined surface and the second inclined surface be formed so that the force in the direction of closing the lock arm is equal to or larger than the force in the direction of opening the lock arm.

In the thermal printer as described above, when the platen roller and the shaft bearings are moved toward the openings of the notches, the force in the direction of closing the lock arm is equal to or larger than the force in the direction of opening the lock arm. Therefore, it is possible to more reliably prevent the platen roller and the shaft bearings from accidentally coming off from the notches (more reliably prevent the platen roller from accidentally being released) to thereby enable further improvement in reliability.

The present invention has an effect of ensuring that the platen roller and the shaft bearings can be prevented from accidentally coming off from the notches to thereby enable improvement.

BRIEF DESCRIPTION OF THE DRAWINGS

In the accompanying drawings:

FIGS. 4A-4B are views showing a state in which the platen roller and shaft bearings are moved to a side opposite to a shaft, in which FIG. 4A is a view similar to FIG. 3, and FIG. 4B is a view further enlarging the main portion of FIG. 4A;

FIGS. 5A-5B are views showing a thermal printer according to a second embodiment of the present invention, in which FIG. 5A is a view similar to FIG. 4A, and FIG. 4B is a view further enlarging the main portion of FIG. 4A;

FIGS. 6A-6B are views showing the thermal printer according to the third embodiment of the present invention, in which FIG. 6A is a view similar to FIG. 4A, and FIG. 6B is a view further enlarging the main portion of FIG. 6A.

DETAILED DESCRIPTION OF THE PREFERRED EMBODIMENT

Hereinafter, the thermal printer according to the first embodiment of the present invention is described with reference to FIGS. 1 to 4A-4B.

Figure 1:
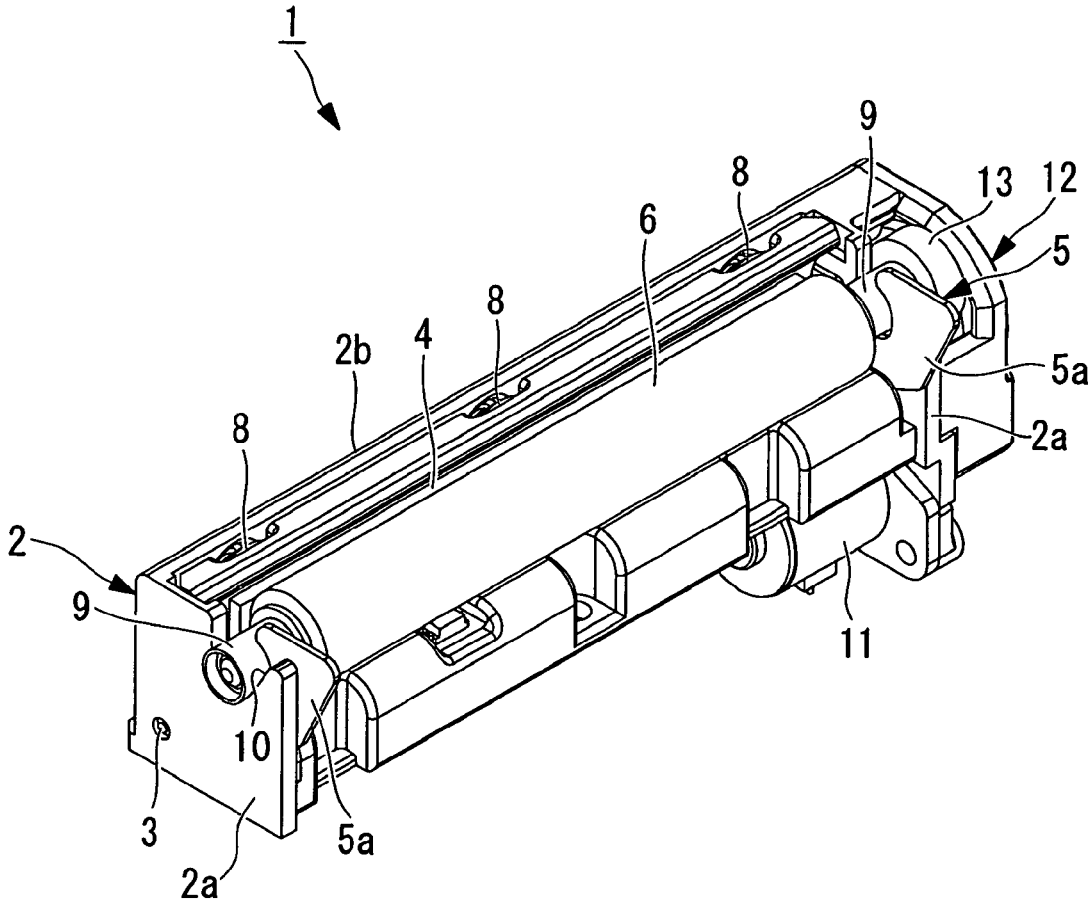
FIG. 1 is a perspective view showing a thermal printer according to a first embodiment of the present invention.
Figure 2:
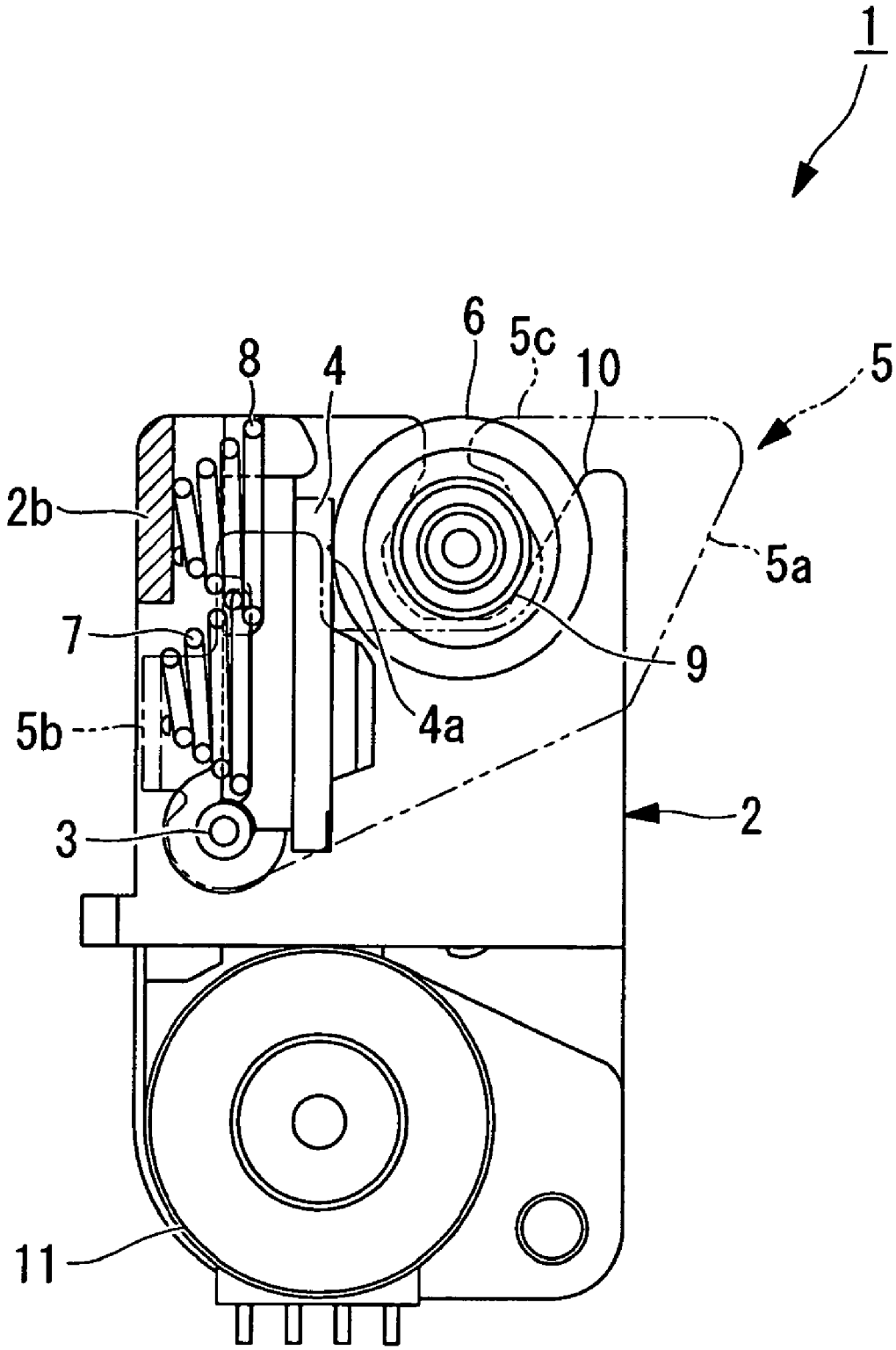
FIG. 2 is a longitudinal sectional view showing a state in which a platen roller of the thermal printer of FIG. 1 is mounted thereto.
Figure 3:
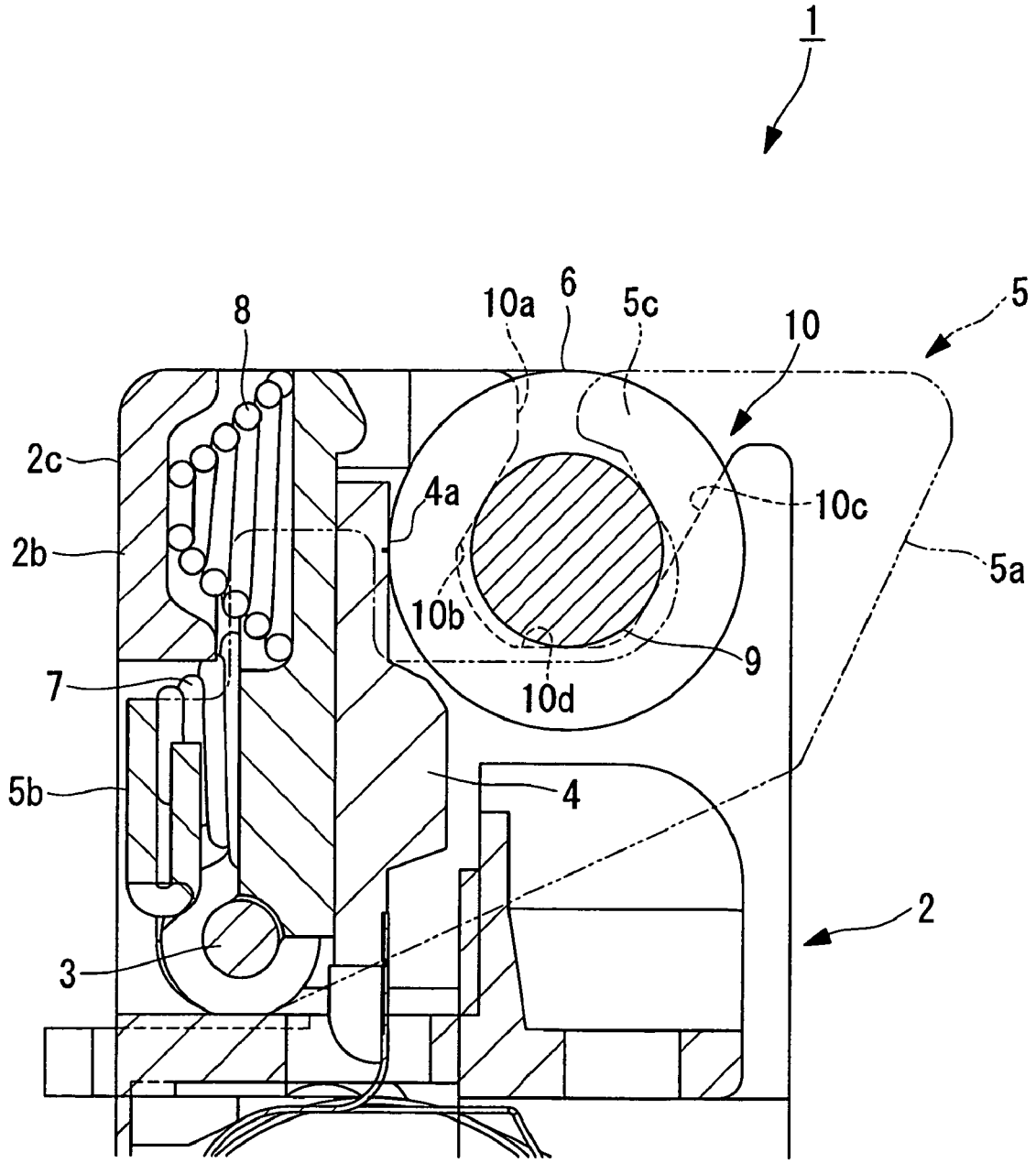
FIG. 3 is an enlarged view of a main portion of FIG. 2.
Figure 4A:
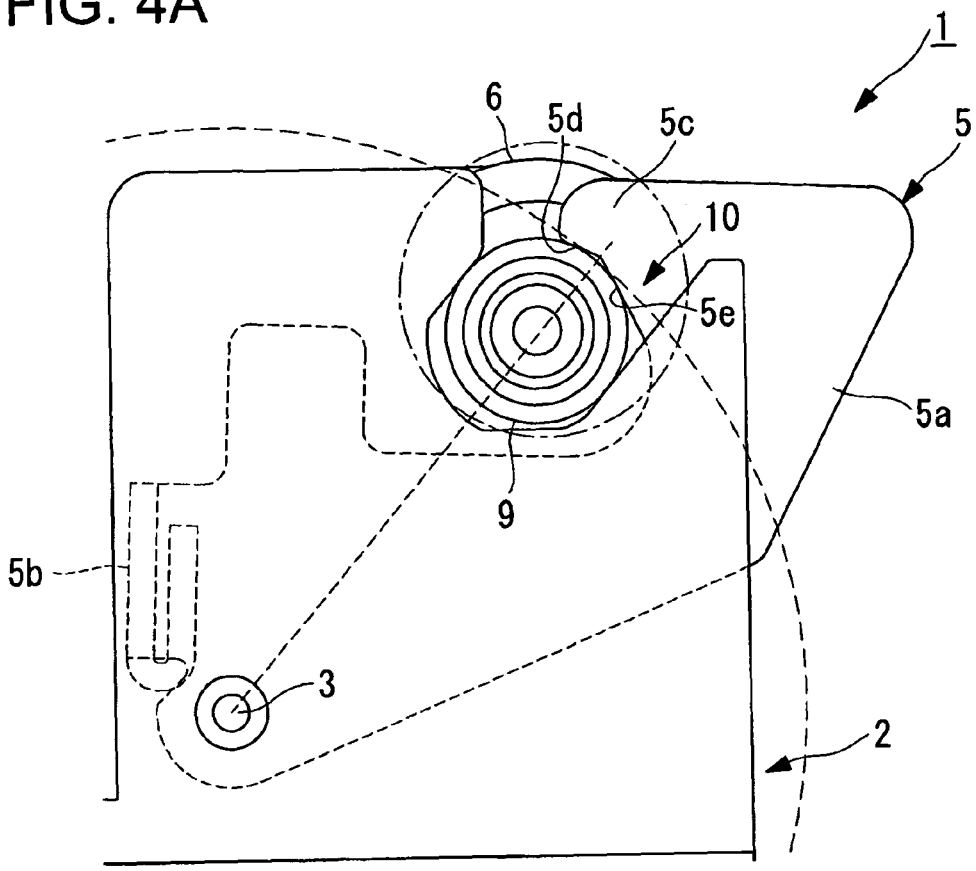
Figure 4B:
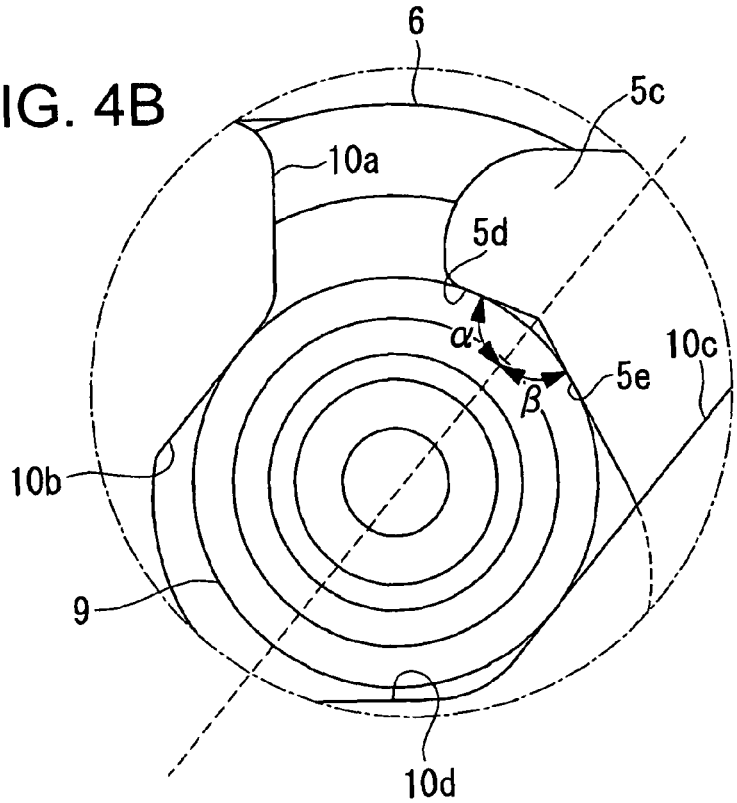

FIG. 1 is a perspective view showing a thermal printer according to this embodiment. FIG. 2 is a longitudinal sectional view showing a state in which a platen roller of the thermal printer of FIG. 1 is mounted. FIG. 3 is an enlarged view of a main portion of FIG. 2. FIGS. 4A-4B are views showing a state in which the platen roller and shaft bearings are moved to the side opposite to a shaft, in which FIG. 4A is a view similar to FIG. 3, and FIG. 4B is a view further enlarging the main portion of FIG. 4A.

As shown in FIG. 1, a thermal printer 1 of this embodiment includes: a main body frame 2; a thermal head 4 and a lock arm 5 swingably mounted to a coaxial shaft (supporting shaft) 3 of the main body frame 2; a platen roller 6 supported by the lock arm 5; first springs 7 (see FIG. 2) for biasing the platen roller 6 to the thermal head 4 side; and second springs 8 for biasing the thermal head 4 in the platen roller 6 direction.

The main body frame 2 is provided with side walls 2*a* bridged by the shaft 3 and a back surface coupling plate portion 2*b* for coupling the side walls 2*a*. The side walls 2*a* of the main body frame 2 are provided with notches or slots 10, respectively, for receiving shaft bearings 9 (described later) of the platen roller 6. Further, the main body frame 2 is provided with a motor 11 and a rotation transmitting mechanism 12 for transmitting a rotational force of the motor 11 to the platen roller 6.

As shown in FIG. 2, the thermal head 4 is mounted to the shaft 3 mounted to the main body frame 2 so as to be capable of swinging or pivoting about the shaft 3 in a state where a side surface, which is a back surface of a printing surface 4*a* provided on one surface side, is opposed to the back surface coupling plate portion 2*b* of the main body frame 2. The printing surface 4*a* of the thermal head 4 is disposed at a position where the printing surface 4*a* approximately corresponds to the back surface coupling plate portion 2*b* in a thickness direction of the thermal head 4.

Further, the second springs 8 are sandwiched between the back surface of the thermal head 4 and the back surface coupling plate portion 2*b* of the main body frame 2 and apply a biasing force in a given direction (horizontal direction in FIG. 2) to the thermal head 4 to bias the thermal head toward the platen roller 6. Each second spring 8 is a compressed coil spring being a conical coil spring. Accordingly, the thermal head 4 is constantly biased in the printing surface 4*a* side due to a biasing force of the second springs 8.

The shaft bearings 9 for rotatably supporting the platen roller 6 are provided on both ends of the platen roller 6, respectively. Further, a gear 13, which engages with a gear 12*a* of the rotation transmitting mechanism 12 when the shaft bearings 9 are supported by the notches 10, is fixed to an end of the platen roller 6 (see FIG. 1).

The lock arm 5 is swingably (pivotally) mounted to the main body frame 2 by the shaft 3 to undergo swinging or pivotal movement between locked and unlocked positions, and includes two side plate portions 5*a* extending along the both side walls 2*a* of the main body frame 2 and a back plate portion 5*b* for coupling the side plate portions 5*a*.

The lock arm 5 is provided with claw portions 5*c* at its end portions, which extend toward the printing surface 4*a* side of the thermal head 4 in the state where the lock arm 5 is mounted to the main body frame 2, and prevent the platen roller 6 from being detached when the lock arm 5 is in the locked position (FIGS. 1-4) by enclosing the shaft bearings 9 of the platen roller 6 supported by the notches 10 of the main body frame 2 to decrease the opening widths of the notches 10. Further, in this state, the back plate portion 5*b* of the lock arm 5 is disposed to the back surface side of the thermal head 4.

In addition, as shown in FIG. 2, the first springs 7 are sandwiched between the back plate portion 5*b* of the lock arm 5 and the back surface of the thermal head 4 and apply a biasing force in a given direction (horizontal direction in FIG. 2), which is parallel to the biasing direction of the second springs 8, to the lock arm 5 to bias the lock arm to the locked position. Each first spring 7 is a compressed coil spring being a conical coil spring.

Accordingly, the lock arm 5 is constantly biased by the first springs 7 in a direction of pressing the shaft bearings 9 of the platen roller 6 against the notches 10 of the main body frame 2. Further, in the state where the shaft bearings 9 of the platen roller 6 are pressed against the notches 10, the claw portions 5*c* decrease the opening widths of the notches 10 and the shaft bearings 9 are supported so as not to be detached from the notches 10, and hence platen roller 6 is locked in a positioning state with respect to the main body frame 2.

Note that in this embodiment, the back plate portion 5*b* of the lock arm 5 is disposed closer to the side of the shaft 3, serving as a swing center of the lock arm 5, than the back surface coupling plate portion 2*b* of the main body frame 2 is. Accordingly, the first springs 7 sandwiched between the back plate portion 5*b* and the back surface of the thermal head 4 are disposed closer to the swing center than the second springs 8 sandwiched between the back surface coupling plate portion 2*b* and the back surface of the thermal head 4 are.

In the thermal printer 1 according to this embodiment, the notches 10 and the claw portions 5*c* have a plan view shape (outline) as shown in FIG. 3.

Specifically, the notches 10 each include a parallel surface 10*a* which is formed so as to be apart from the back surface coupling plate portion 2*b* by a predetermined distance and to be parallel (or substantially parallel) to the back surface 2*c* of the back surface coupling plate portion 2*b*, a first inclined surface 10*b* which is inclined with respect to the parallel surface 10*a* and extends from an end edge (lower edge) of the parallel surface 10*a* to the shaft 3 side, a second inclined surface 10*c* which is formed so as to be parallel (or substantially parallel) to the first inclined surface 10*b*, and a bottom surface 10*d* which is coupled to an end edge (lower edge) of the first inclined surface 10*b* and an end edge (lower edge) of the second inclined surface 10*c*. Further, a space formed by the first inclined surface 10*b*, the second inclined surface 10*c*, and the bottom surface 10*d* is formed so as to be capable of receiving (containing) the shaft bearings 9 of the platen roller 6.

Further, as shown in FIG. 4A and FIG. 4B, the claw portions 5*c* each include a third inclined surface (first inclined surface) 5*d* and a fourth inclined surface (second inclined surface) 5*e* which come into contact, when the platen roller 6 and the shaft bearings 9 are moved to the side opposite to the shaft 3 side, with an outer peripheral surface of each of the shaft bearings 9 placed on the side opposite to the shaft 3.

The third inclined surface 5*d* is a flat surface which generates, in the case where the platen roller 6 and the shaft bearings 9 are moved to the side opposite to the shaft 3 and the outer peripheral surface of each of the shaft bearings 9 comes into contact with the third inclined surface 5*d*, the force on the lock arm 5 in the direction of closing the lock arm 5 (counterclockwise direction in FIG. 4A). Further, the fourth inclined surface 5*e* is a flat surface which generates, in the case where the platen roller 6 and the shaft bearings 9 are moved to the side opposite to the shaft 3 and the outer peripheral surface of each of the shaft bearings 9 comes into contact with the fourth inclined surface 5*e*, the force on the lock arm 5 in the direction of opening the lock arm 5 (clockwise direction in FIG. 4A).

Note that an angle $\alpha$ formed between the third inclined surface 5*d* and a straight line extending from the center of the shaft, an angle $\beta$ formed between the fourth inclined surface 5*e* and the straight line extending from the center of the shaft, the length of the third inclined surface 5*d* (that is, the length from a contact point (border) between the third inclined surface 5*d* and the fourth inclined surface to a contact point between the third inclined surface 5*d* and the outer peripheral surface of each of the shaft bearings 9), and the length of the fourth inclined surface 5*e* (that is, the length from the contact point (border) between the third inclined surface 5*d* and the fourth inclined surface to a contact point between the fourth inclined surface 5*e* and the outer peripheral surface of each of the shaft bearings 9) are set to be such angles and lengths that the platen roller 6 and the shaft bearings 9 do not come off from the notches 10 even when the platen roller 6 and the shaft bearings 9 are moved to the side opposite to the shaft 3. For example, when the angle α formed between the third inclined surface 5*d* and the straight line extending from the center of the shaft is smaller than the angle β formed between the fourth inclined surface 5*e* and the straight line extending from the center of the shaft, the force by which the lock arm 5 is closed becomes larger than the force by which the lock arm 5 is opened. Further, when the angle α formed between the third inclined surface 5*d* and the straight line extending from the center of the shaft is equal to the angle β formed between the fourth inclined surface 5*e* and the straight line extending from the center of the shaft, the force by which the lock arm 5 is closed becomes equal to the force by which the lock arm 5 is opened.

An operation of the thermal printer 1 of this embodiment structured as described above is described below.

According to the thermal printer 1 of this embodiment, in performing printing while sandwiching thermal paper (not shown) between the thermal head 4 and the platen roller 6, first, the thermal paper is disposed on the printing surface 4*a* of the thermal head 4. Then, an external force is applied to the lock arm 5 to swing the lock arm 5 in a direction of moving the claw portions 5*c* away from the thermal head 4 to increase opening widths of the notches 10 provided to the side walls 2*a* of the main body frame 2.

In this case, the first springs 7 disposed between the back plate portion 5*b* of the lock arm 5 and the back surface of the thermal head 4 are compressed, and hence the lock arm 5 is swung against a biasing force of the first springs 7 to the unlocked position to enable the shaft bearings 9 to be inserted into and removed from the notches (slots) 10. In order to satisfactorily increase the opening width of each notch 10 of each side wall 2*a* of the main body frame 2, the claw portions 5*c* of the lock arm 5 should be satisfactorily swung. Accordingly, the first springs 7 are compressed.

In this embodiment, the first springs 7 are disposed closer to the shaft 3, serving as the swing center (pivot axis) of the lock arm 5, than the claw portions 5*c* of the lock arm 5 are. Therefore, the first springs 7 having a stroke satisfactorily smaller than a displacement amount of the claw portions 5*c* can be used. As a result, a provision space of the first springs 7 disposed on the back surface side of the thermal head 4 can be made smaller.

As the first springs 7, conical coil springs are used. Thus, it is possible to reduce solid height thereof, and the provision space thereof can be made further smaller.

Further, in a state where the platen roller 6 is not mounted, the thermal head 4 is biased to the printing surface 4*a* side by the second springs 8 to swing about the shaft 3. In a case where the lock arm 5 is swung in a direction of increasing the opening widths of the notches 10, the platen roller 6 is detached from the notches 10. Thus, the thermal head 4 swings to the printing surface 4*a* side, thereby reducing the stroke of the first springs 7.

Then, with the lock arm 5 in the unlocked position, the shaft bearings 9 of the both ends of the platen roller 6 are inserted into the notches 10 having the increased opening widths, whereby the notches 10 support the shaft bearings 9. In this state, the external force applied to the lock arm 5 is released. Accordingly, the lock arm 5 biases the platen roller 6 in a direction so that the platen roller 6 comes closer to the thermal head 4 and presses each of the shaft bearings 9 against the first inclined surface 10*b*, the second inclined surface 10*c*, and the bottom surface 10*d* of each of the notches 10 of the main body frame 2, the claw portions 5*c* move in a direction of decreasing the opening widths of the notches 10, and the shaft bearings 9 of the platen roller 6 are supported by the claw portions 5*c* so as not to be detached from the notches 10. Accordingly, the platen roller 6 is locked in a positioning state with respect to the main body frame 2.

In this embodiment, the thermal head 4 is biased to the printing surface 4*a* side by the second springs 8. Thus, at a position in the midst of the lock operation by the lock arm 5, the platen roller 6 sandwiches the thermal paper with the printing surface 4*a* of the thermal head 4. When the lock operation by the lock arm 5 completes, the platen roller 6 presses the thermal head 4 to sandwich the thermal paper, thereby compressing the second springs 8.

In this case, the shaft bearings 9 of the platen roller 6 are each pressed against the first inclined surface 10*b*, the second inclined surface 10*c*, and the bottom surface 10*d* of each of the notches 10, whereby the platen roller 6 is positioned. In addition, the position of the back surface coupling plate portion 2*b* for supporting the second springs 8 is fixed. Therefore, when the platen roller 6 is locked by the lock arm 5, the second springs 8 are always compressed by a specific length. Accordingly, the thermal paper is always sandwiched between the thermal head 4 and the platen roller 6 by a specific pressurizing force with the result that stable printing can be performed without fluctuating printing conditions. Then, the platen roller 6 is rotated by the operation of the motor 11 via the rotation transmitting mechanism 12 to feed the thermal paper, whereby printing is performed by the thermal head 4.

Further, the second springs 8 are disposed so as to be opposed to a contact position of the platen roller 6 and the printing surface 4*a* of the thermal head 4 with an intermediation of the thermal head 4, and apply a biasing force along an extended line connecting the contact position and a center position of the platen roller 6. Thus, the biasing force which is generated by the second springs 8 can be efficiently used as a pressurizing force of the printing surface 4*a* with respect to the thermal paper to minimize dimensions of the second springs 8.

Further, in this embodiment, the second springs 8 for pressing the thermal head 4 are not used to return the lock arm 5 to its original state, and hence each second spring 8 does not need large stroke. Therefore, it is possible to reduce the stroke to make the provision space smaller.

According to the thermal printer 1 of the present invention, even when, for example, thermal paper placed (set) between the thermal head 4 and the platen roller 6 is pulled for cutting, whereby the platen roller 6 and the shaft bearings 9 are moved to the side opposite to the shaft 3, a force in the direction of closing the lock arm 5 is generated due to the third inclined surface 5*d*, and hence it is possible to prevent the platen roller and the shaft bearings 9 from accidentally coming off from the notches 10 (to prevent the platen roller 6 from accidentally being released) to thereby enable improvement in reliability.

A thermal printer according to a second embodiment of the present invention is described with reference to FIGS. 5A-5B.

Figure 5A:
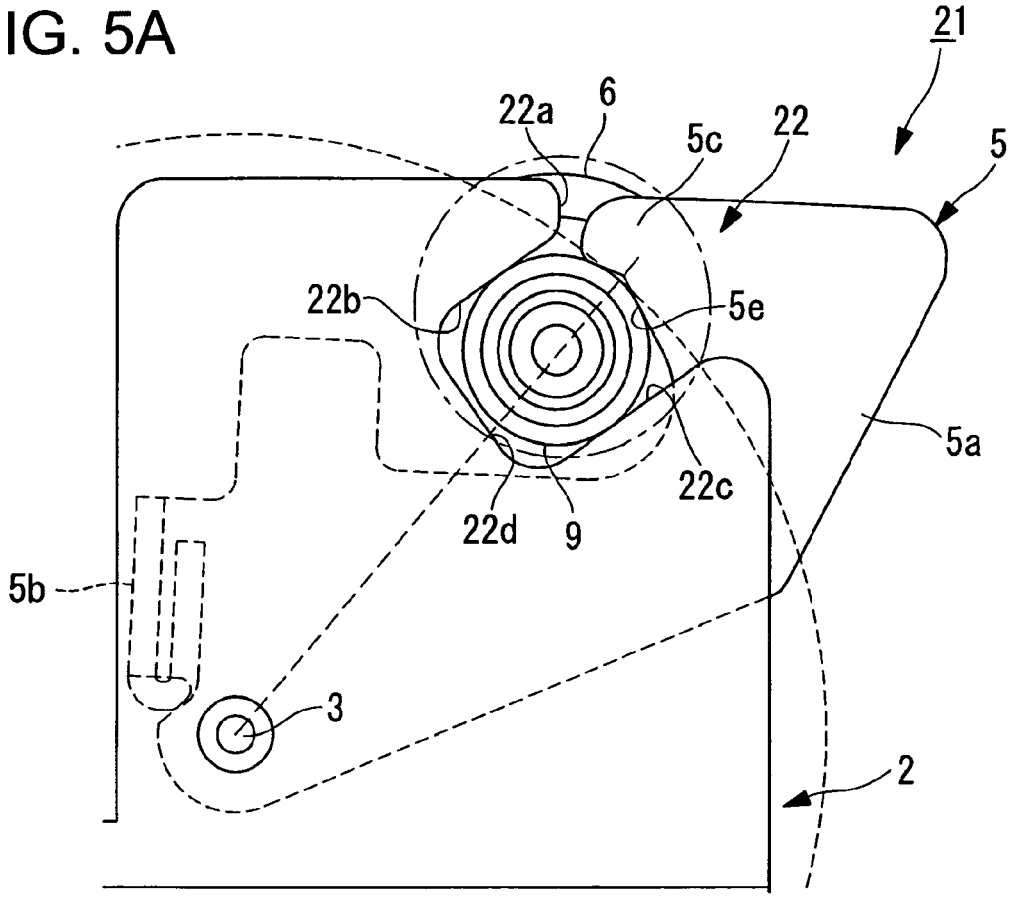
Figure 5B:
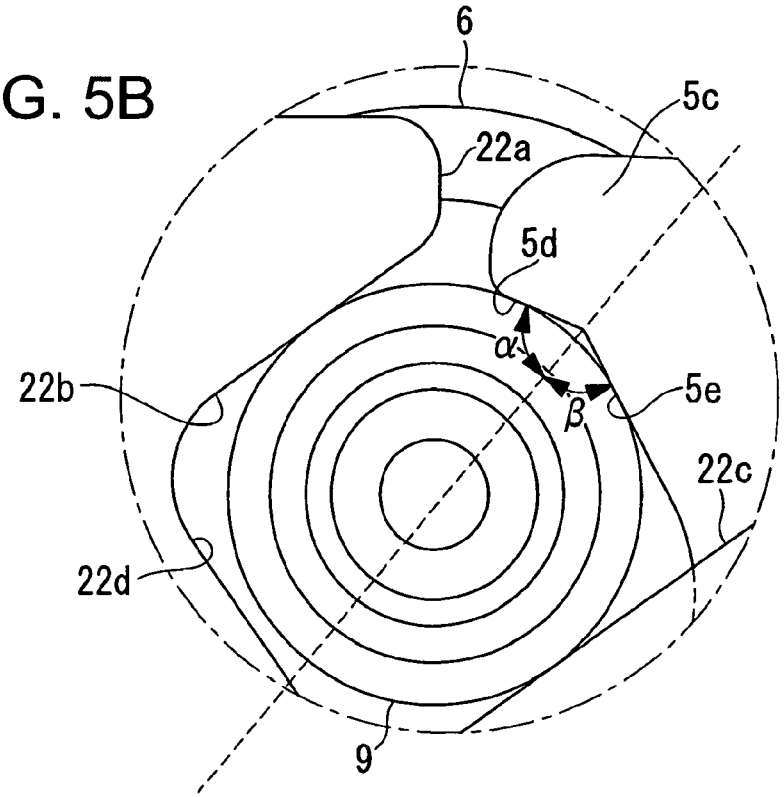

FIGS. 5A-5B are views showing the thermal printer according to this embodiment, in which FIG. 5A is a view similar to FIG. 4A, and FIG. 5B is a view further enlarging the main portion of FIG. 5A.

As shown in FIGS. 5A-5B, a thermal printer 21 according to this embodiment is different from the above-mentioned thermal printer according to the first embodiment in that notches 22 are provided instead of the notches 10. Other components are the same as those of the above-mentioned first embodiment, and hence the descriptions thereof are omitted here.

The notches 22 each include a parallel surface 22*a* which is formed so as to be apart from the back surface coupling plate portion 2*b* (see FIG. 2 and FIG. 3) by a predetermined distance and to be parallel (or substantially parallel) to the back surface 2*c* (see FIG. 3) of the back surface coupling plate portion 2*b*, a first inclined surface 22*b* which is inclined with respect to the parallel surface 22*a* and extends from an end edge (lower edge) of the parallel surface 22*a* to the shaft 3 side, a second inclined surface 22*c* which is formed so as to be parallel (or substantially parallel) to the first inclined surface 22*b*, and a bottom surface 22*d* which couples an end edge (lower edge) of the first inclined surface 22*b* and an end edge (lower edge) of the second inclined surface 22*c*. Further, a space formed by the first inclined surface 22*b*, the second inclined surface 22*c*, and the bottom surface 22*d* is formed so as to be capable of receiving (containing) the shaft bearings 9 of the platen roller 6.

Note that the first inclined surface 22*b* and the second inclined surface 22*c* according to this embodiment are formed so that angles formed between each of the first inclined surface 22*b* and the second inclined surface 22*c*, and the back surface 2*c* of the back surface coupling plate portion 2*b* are larger than angles formed between each of the first inclined surface 10*b* and the second inclined surface 10*c* of the first embodiment, and the back surface 2*c* of the back surface coupling plate portion 2*b*, respectively. That is, the first inclined surface 22*b* and the second inclined surface 22*c* of this embodiment are formed so that the openings of the notches 22 face the front side (opposite side with respect to the back surface 2*c* of the back surface coupling plate portion 2*b*) compared with the openings of the notches 10.

The effect of the thermal printer 21 according to this embodiment is the same as that of the above-mentioned first embodiment, and hence the description thereof is omitted.

A thermal printer according to a third embodiment of the present invention is described with reference to FIGS. 6A-6B.

Figure 6A:
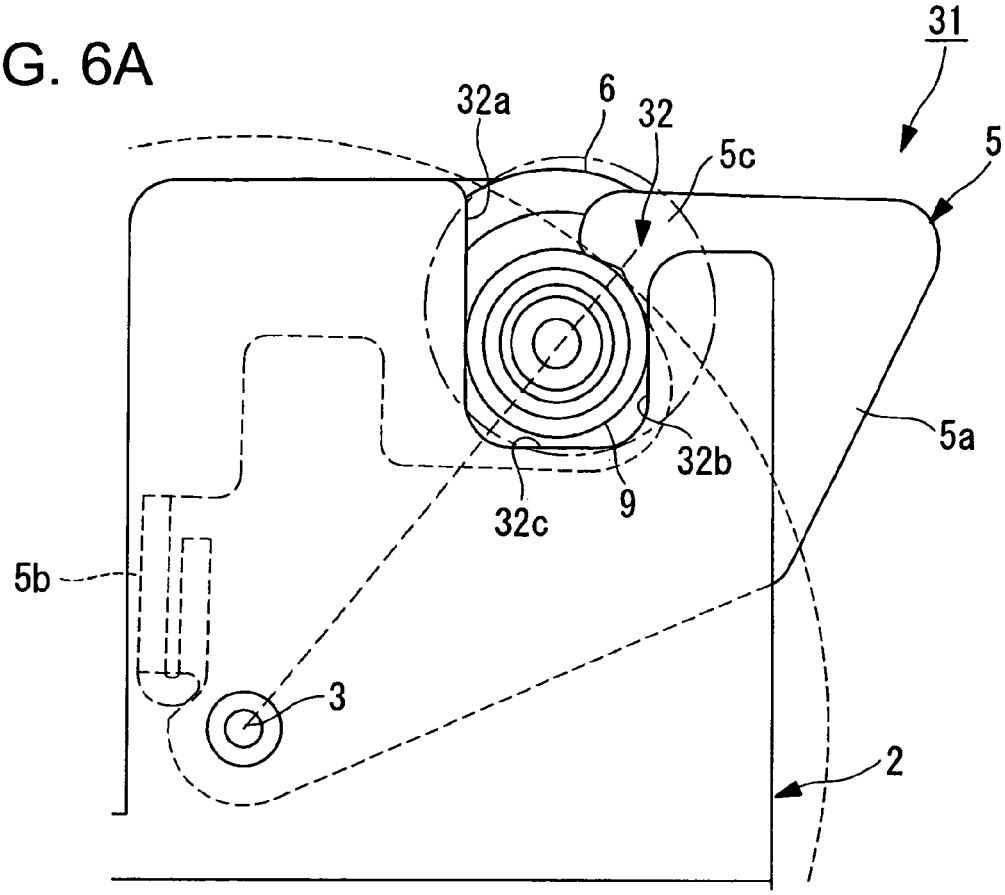
Figure 6B:
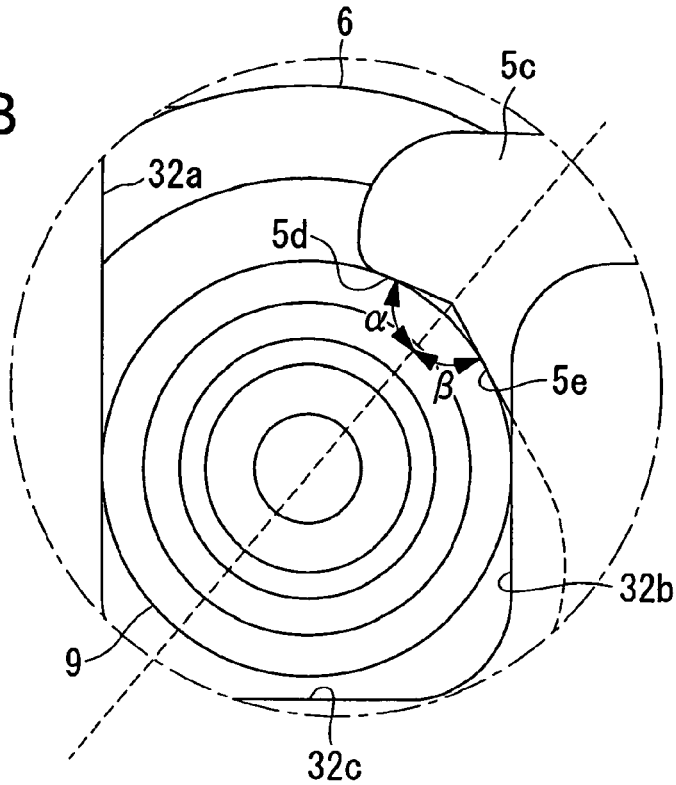

FIGS. 6A-6B are views showing the thermal printer according to this embodiment, in which FIG. 6A is a view similar to FIG. 4A, and FIG. 6B is a view further enlarging the main portion of FIG. 6A.

As shown in FIGS. 6A-6B, a thermal printer 31 according to this embodiment is different from the above-mentioned thermal printer according to the first embodiment in that notches 32 are provided instead of the notches 10. Other components are the same as those of the above-mentioned first embodiment, and hence the descriptions thereof are omitted here.

The notches 32 each include a first parallel surface 32*a* which is formed so as to be apart form the back surface coupling plate portion 2*b* (see FIG. 2 and FIG. 3) by a predetermined distance and to be parallel (or substantially parallel) to the back surface 2*c* (see FIG. 3) of the back surface coupling plate portion 2*b*, a second parallel surface 32*b* which is formed so as to be parallel (or substantially parallel) to the first parallel surface 32*a*, and a bottom surface 32*c* which couples an end edge (lower edge) of the first parallel surface 32*a* and an end edge (lower edge) of the second parallel surface 32*b*. Further, a space formed by the first parallel surface 32*a*, the second parallel surface 32*b*, and the bottom surface 32*c* is formed so as to be capable of receiving (containing) the shaft bearings 9 of the platen roller 6.

The effect of the thermal printer 31 according to this embodiment is the same as that of the above-mentioned first embodiment, and hence the description thereof is omitted.

Note that the present invention is not limited to the above-mentioned embodiments, and can be varied, modified, or combined arbitrarily as needed without departing from the technical idea of the present invention.

Further, in the embodiments described above, the third inclined surface 5*d* and the fourth inclined surface 5*e* are directly connected to each other. However, the present invention is not limited thereto, and hence the third inclined surface 5*d* and the fourth inclined surface 5*e* may be connected through the intermediation of a fifth inclined surface (planer surface or curved surface) (not shown) and the like.

In this case, when the angle α formed between the third inclined surface 5*d* and the straight line extending from the center of the shaft is equal to or smaller than the angle β formed between the fourth inclined surface 5*e* and the straight line extending from the center of the shaft, and the length of the third inclined surface 5*d* (that is, the length from the contact point (border) between the third inclined surface 5*d* and the fourth inclined surface 5*e* to the contact point between the third inclined surface 5*d* and the outer peripheral surface of the shaft bearing 9) is longer than the length of the fourth inclined surface 5*e* (that is, the length from the contact point (border) between the third inclined surface 5*d* and the fourth inclined surface 5*e* to the contact point between the fourth inclined surface 5*e* and the outer peripheral surface of the shaft bearing 9), a force by which the lock arm 5 is closed becomes larger than a force by which the lock arm 5 is opened. Further, when the angle α formed between the third inclined surface 5*d* and the straight line extending from the center of the shaft is equal to the angle β formed between the fourth inclined surface 5*e* and the straight line extending from the center of the shaft, and the length of the third inclined surface 5*d* is equal to the length of the fourth inclined surface 5*e*, the force by which the lock arm 5 is closed becomes equal to the force by which the lock arm 5 is opened.

Further, the notches 10, 22, 32 of the embodiments described above are formed so that the first inclined surface 10*b*, 22*b* and the second inclined surface 10*c*, 22*c* become parallel (or substantially parallel) to each other, and formed so that the first parallel surface 32*a* and the second parallel surface 32*b* become parallel (or substantially parallel) to each other. However, the present invention is not limited thereto, and hence the opening width may be increased toward the opening direction.

Further, in the thermal printer 1, 21, and 31 according to the embodiments described above, conical coil springs are employed as the first springs 7 and the second springs 8. Alternatively, as shown in FIG. 7, plate springs 37 and 38 may be employed.

Figure 7:
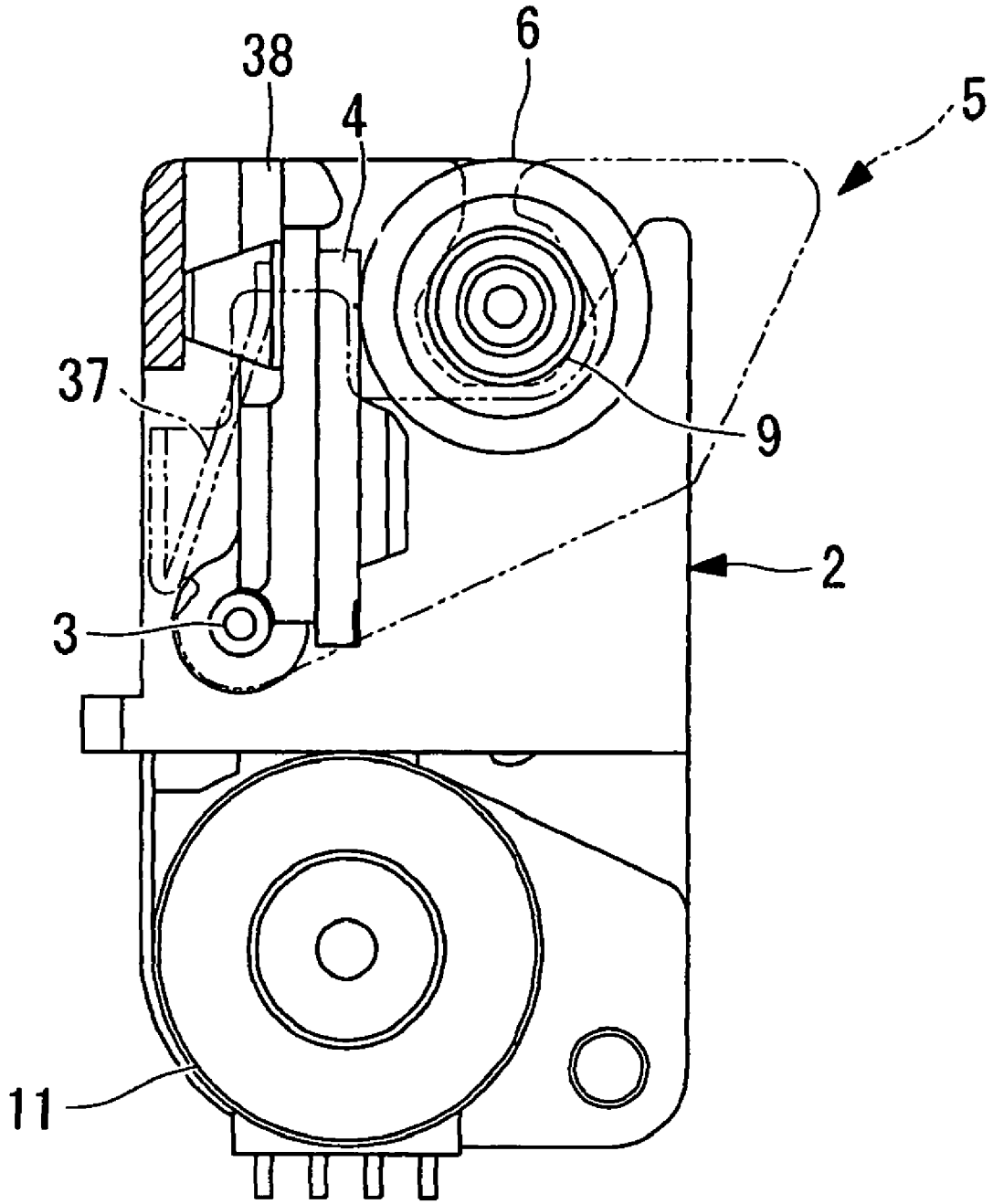
FIG. 7 is a view showing a thermal printer according to another embodiment of the present invention, which is a longitudinal sectional view showing a state in which the platen roller is mounted thereto.

As shown in FIG. 7, a first spring 37 for biasing the lock arm 5 and a second spring 38 for pressing the thermal head 4 are constituted by different plate springs.

The first spring 37 is constituted by extending a portion of the back plate portion 5*b* constituting the lock arm 5. Another end of the first spring 37 is extended to a back surface side of the second spring 38, whereby the biasing force for biasing the thermal head 4 with respect to the platen roller 6 can be increased.

Further, by separately providing the first spring 37 and the second spring 38, as described above, the provision space in the back surface side of the thermal head 4 can be made smaller to make it compact. In particular, by employing the plate springs, even in the smaller provision space, a relatively large biasing force can be exerted to perform stable printing.

What is claimed is:

1. A thermal printer, comprising:

a main body frame having two opposed notches;

a thermal head swingably mounted to the main body frame;

a platen roller disposed so as to be opposed to a printing surface of the thermal head for sandwiching thermal paper with the thermal head to feed the thermal paper;

a lock arm that is swingably mounted to a supporting shaft mounted to the main body frame and that presses shaft bearings rotatably supporting the platen roller to a thermal head side to lock the platen roller with the notches of the main body frame, first springs for biasing the platen roller supported by the lock arm to the thermal head side; and second springs for biasing the thermal head in the platen roller direction, wherein the lock arm is provided, on a tip end portion thereof, with a first inclined surface which, when the platen roller and the shaft bearings are moved toward openings of the notches, comes into contact with an outer peripheral surface of each of the shaft bearings and generates a force in a direction of closing the lock arm, the first springs and the second springs are arranged so that their directions of biasing are parallel, and the first springs are disposed closer to the supporting shaft than the second springs and the first inclined surface of the lock arm.

2. A thermal printer according to claim 1, wherein the lock arm is provided, on the tip end portion thereof, with a second inclined surface which, when the platen roller and the shaft bearings are moved toward the openings of the notches, comes into contact with the outer peripheral surface of each of the shaft bearings and generates a force in a direction of opening the lock arm, and wherein the first inclined surface and the second inclined surface are formed so that the force in the direction of closing the lock arm is equal to or larger than the force in the direction of opening the lock arm.

3. A thermal printer, comprising:

a main body frame having two spaced-apart opposed slots;

a platen roller having shaft bearings removably inserted in the two slots to rotatably support the platen roller on the main body frames;

a thermal head mounted on the main body frame for movement toward and away from the platen roller and coacting therewith to perform printing on a thermal paper sandwiched between the thermal head and the platen roller;

a lock arm movable between a locked position in which the lock arm locks the shaft bearings and prevents their removal from the slots and an unlocked position in which the lock arm enables removal of the shaft bearings from the slots;

first springs that apply a biasing force in a first direction to the lock arm to bias the lock arm to the locked position; and second springs that apply a biasing force in a second direction, parallel to the first direction, to the thermal head to bias the thermal head toward the platen roller.

4. A thermal printer according to claim 3; wherein the lock arm is pivotally mounted by a supporting shaft to undergo pivotal movement between the locked and unlocked positions, and the first and the second springs are disposed completely above the level of the supporting shaft.

5. A thermal printer according to claim 4; wherein the lock arm has a back plate portion that extends along a back portion of the main body frame, the first springs being sandwiched in a compressed state between the back plate portion and the thermal head.

6. A thermal printer according to claim 3; wherein the lock arm is pivotally mounted to undergo pivotal movement about a pivot axis between the locked and unlocked positions, and the first springs are disposed closer to the pivot axis than the second springs.

7. A thermal printer according to claim 6; wherein the lock arm has a back plate portion that extends along a back portion of the main body frame, the first springs being sandwiched in a compressed state between the back plate portion and the thermal head.

8. A thermal printer according to claim 7; wherein the second springs are sandwiched in a compressed state between the back portion of the main body frame and the thermal head.

9. A thermal printer according to claim 8; wherein the first and second springs are coil springs.

10. A thermal printer according to claim 8; wherein the first and second springs are plate springs.

11. A thermal printer according to claim 3; wherein the first and second springs are coil springs.

12. A thermal printer according to claim 3; wherein the first and second springs are plate springs.

13. A thermal printer according to claim 3; wherein the lock arm has a back plate portion that extends along a back portion of the main body frame, the first springs being sandwiched in a compressed state between the back plate portion and the thermal head.

14. A thermal printer according to claim 13; wherein the lock arm is pivotally mounted to undergo pivotal movement about a pivot axis between the locked and unlocked positions, and the first springs are disposed closer to the pivot axis than the second springs.

15. A thermal printer according to claim 13; wherein the second springs are sandwiched in a compressed state between the back portion of the main body frame and the thermal head.

16. A thermal printer according to claim 15; wherein the first and second springs are coil springs.

17. A thermal printer according to claim 15; wherein the first and second springs are plate springs.

18. A thermal printer according to claim 3; wherein the first and second springs are compression springs.

* * * * *